US006367119B1

(12) United States Patent
Jou

(10) Patent No.: US 6,367,119 B1
(45) Date of Patent: Apr. 9, 2002

(54) DUAL-DUTY BLOWING AND EXHAUSTING APPARATUS

(76) Inventor: Wuu-Cheau Jou, No. 95, Cheng Kung $2^{nd}$ Road, Tali City, Taichung Hsien (TW)

( * ) Notice: Subject to any disclaimer, the term of this patent is extended or adjusted under 35 U.S.C. 154(b) by 0 days.

(21) Appl. No.: 09/401,519

(22) Filed: Sep. 22, 1999

(51) Int. Cl.[7] ..... A47L 5/14
(52) U.S. Cl. ..... 15/330; 15/337; 15/409
(58) Field of Search ..... 15/330, 337, 409

(56) References Cited

U.S. PATENT DOCUMENTS

| | | | | | |
|---|---|---|---|---|---|
| 2,324,422 | A | * | 7/1943 | Patterson | 15/409 |
| 2,846,710 | A | * | 8/1958 | Haka | 15/409 X |
| 2,851,213 | A | * | 9/1958 | Swallert | 15/409 X |
| 3,525,118 | A | * | 8/1970 | Viollet | 15/409 X |
| 3,964,123 | A | * | 6/1976 | Pettersson | 15/409 X |
| 3,967,341 | A | * | 7/1976 | Gavin | 15/409 X |
| 4,055,870 | A | * | 11/1977 | Furutsutsumi | 15/409 |
| 5,924,166 | A | * | 7/1999 | Jones et al. | 15/409 X |

FOREIGN PATENT DOCUMENTS

| | | | | |
|---|---|---|---|---|
| DE | 1022770 | * | 1/1958 | 15/409 |

* cited by examiner

*Primary Examiner*—Chris K. Moore
(74) *Attorney, Agent, or Firm*—Rosenberg, Klein & Lee

(57) ABSTRACT

A dual-duty blowing and exhausting apparatus is provided. The apparatus may be quickly and conveniently converted between blowing and exhausting configurations without exposing its parts to undue wear or damage, and without causing the escape of the collected dust or other scrap material. The apparatus comprises a body member formed with an intermediate cylinder section having a conically contoured internal surface portion coaxially disposed about an axial bore. The apparatus also includes an exhaust valve coupled to a first end section of the body member in substantially sealed manner. This exhaust valve serves to guide compressed air introduced into the body member to the conically contoured internal surface portion for expulsion through the tapered throat portion during the exhausting operation. The apparatus further includes a blow valve detachably coupled to the exhaust valve for effecting the blowing operation. The blow valve includes a substantially tubular member which receives a central shaft sleeve member having a plurality of angularly offset fins extending radially therefrom. The central shaft sleeve member receives in spring biased manner a slide rod, on a radially flared flange to which is coupled a gasket seal that obstructs the axial bore upon the blow valve's coupling to the exhaust valve. The compressed gas introduced into the body member is thus deflected to the blow valve for expulsion through the gun-barrel section.

1 Claim, 11 Drawing Sheets

DUAL-DUTY BLOWING AND EXHAUSTING APPARATUS

BACKGROUND OF THE INVENTION

1. Field of the Invention

The present invention relates to a dual-duty blowing and exhausting apparatus, and more particularly to such apparatus which is convertible between blowing and exhausting configurations in a simple and rapid manner without undue wear or damage of parts, or leakage of any collected material.

2. Description of the Prior Art

In accordance with common practice, industrial exhaust devices used in various factories to exhaust dust, iron scurf, wood flour, and various scraps are configured to perform just a one-way exhaust function. Referring to FIG. 1, a conventional device employing a high speed jet of compressed air to generate strong suction for exhausting dust is shown. The device comprises an air valve 11 controlling the introduction of compressed air into the device body 12; a direction valve 13 placed adjacent the air valve 11 in the device body 12; a locking sleeve 14 securing the direction valve 13 in the device body 12 at its back side; a pair of O-rings 131, 132 located at the opposed ends of the direction valve 13 for preventing leakage of the compressed air; a hose 15 connected at the rear end of the locking sleeve 13 and clamped by a binding ring 16; and, a dust collecting bag (not shown in the Drawing) connected at the end of the hose 15. Formed between the outside wall of the direction valve 13 and body 12 is a ring groove that communicates with diagonal air holes 133 for guiding the compressed air. By appropriately controlling the air valve 11, the compressed air is allowed into the body 12, such that it passes through the air holes 133 of the direction valve 13 to jet into the locking sleeve 14. Due to the circular arrangement of the air holes 133, the jetting current of high speed air generates strong suction so that dust, iron scurf, wood flour and various scraps are exhausted into the dust collector. Referring to FIG. 2 and FIG. 3, various auxiliary extending accessories may be attached to the inlet of the exhaust pipe to meet the requirements of different applications.

If the user wishes to effect a blower function with the device, he/she must first convert the orientation of the direction valve 13 within the device body 12. Referring to FIG. 4, this conversion is carried out by first releasing the binding ring 16 so as to disconnect the hose 15 from the locking sleeve 14; disengaging the locking sleeve 14 from the back end of the device body 12; then taking the direction valve 13 out carefully, making sure that the two O-rings 131, 132 are drawn out together at the same time. Referring to FIG. 5, the direction valve 13 is inverted in orientation so that the direction of the air holes 133 are oriented toward the front device body 12. Thus reoriented, the direction valve 13 is placed back into the device body 12 again and retained therein by securing the locking sleeve 14 into the device body 12. The hose 15 is then re-connected to the locking sleeve 14, as shown in FIG. 6. Because the air holes 133 of the direction valve 13 are now directed towards the front end, the jetting air current will also be directed towards the front side to serve a blower function. This conventional device thus converts in function between exhausting and blowing, but only after disassembly and re-assembly to change the orientation of the direction valve 13. This structure has the following shortcomings:

1. Complicated procedure for converting the working function as above-described: the operator has to loosen the binding ring 16, uninstall the hose 15, remove the locking sleeve 14 and direction valve 13, re-orient the direction valve 13, then put it into place again, making sure that the locking sleeve is replaced again. The hose 15 is re-connected, and the binder ring 15 is again tightened.

2. If frequent changing of the working functions is necessary, the parts will be damaged easily. If the direction valve 13 has to be re-oriented frequently, scratching and wearing of parts will occur during repeated assembling and disassembling operations so as to diminish the resulting device operation.

3. Confusing direction: when changing the direction of the direction valve 13, the user is often confused as to the proper orientation of the air holes with reference to the outside profile, and the direction valve 13 is often misoriented.

4. The O-rings slide out easily: the two O-rings 131, 132 placed on the ends of the direction valve 13 are, due to their tight sealing function, not tightly compressed against the inside wall of the device body 12 by the direction valve 13 and the locking sleeve 14. But when the direction valve 13 is removed too often, there is a great likelihood that the O-ring 131 may remain adhered to the inside of the cylinder of the device 12. If the operator does not discover this problem, replacement of the direction valve 13 upon re-orientation will result in both O-rings 131, 132 being located at the inner end, with the outer end remaining without an O-ring seal. Leakage when then occur after re-assembly.

5. When the O-rings are often drawn out and re-mounted repeatedly, the friction between the inside wall of the cylinder and the outside surface of the O-rings will wear and scratch at the outer surface of the O-rings. In those cases where the clamped O-ring 131 is removed with a needle shaped hook (as is often done), the needle-shaped tip of the hook may damage the surface of the O-ring, causing leakage to occur eventually.

6. For inverting the direction valve 13, so many related parts have to be disassembled that much time is consumed, and upon disassembly, the loose parts are easily lost before re-assembly.

7. The reassembled O-rings 131, 132 have to be carefully adjusted to their positions in order to prevent their shape from distorting under the pressing engagement of the direction valve. If not carefully adjusted, distortion may cause the O-rings to lose their sealing function.

8. If the operator does not know the conversion procedure well, and disassembles the device without first disconnecting the hose 15, the collected dust, wood flour, iron scurf and other various scraps in the collecting bag will escape out of the device and contaminate the surrounding area.

OBJECTS AND SUMMARY OF THE INVENTION

It is therefore a main object of the present invention to provide a dual-duty blowing and exhaust apparatus in which the body includes extending therefrom a connection portion for directly attaching a hose. An exhaust valve is secured on the front end of the body for conducting the jet air current to a back side to generate suction.

It is another object of the present invention to provide a dual-duty blowing and exhaust apparatus, wherein a blow valve is secured at a front end of the exhaust valve. The blow valve has an elastic slide rod at the end extending to the exhaust valve to touch against a throat portion of the body with its terminal surface, so as to block the backward channel and cause re-direction of the compressed air flow towards the front side. The re-directed air flow jets out from a front end mouth to form a blower jet current. In accordance with the present invention, the apparatus may be converted in its working function without disassembling any parts. One need only secure a blow valve to the front end of the exhaust valve. The operation is very simple and convenient, eliminating much of the potential for operator error.

DETAILED DESCRIPTION OF THE PREFERRED EMBODIMENTS

Figure 1:
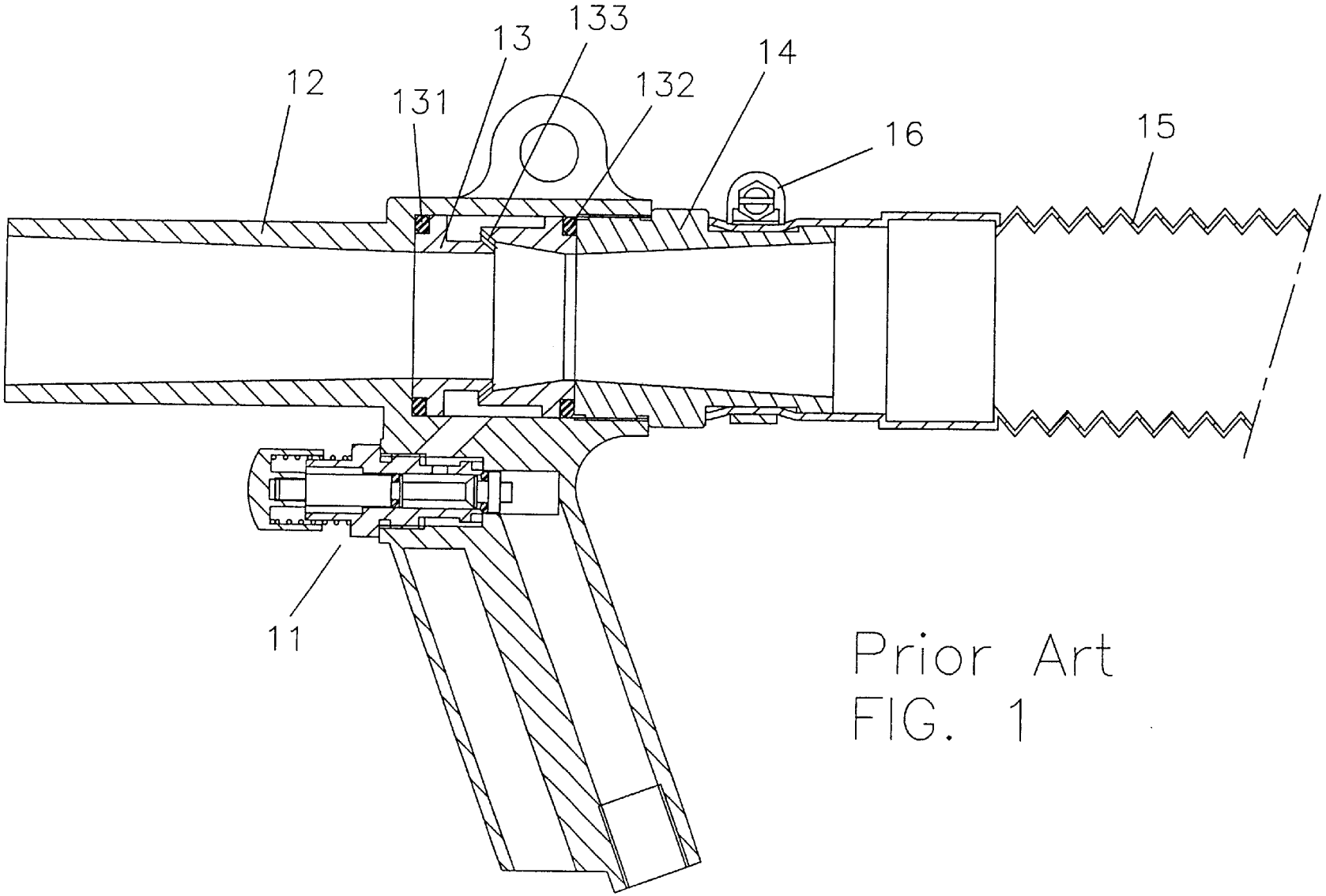
Prior Art FIG. 1
FIG. 1 is a cross-section view of a device of the prior art.
Figure 2:
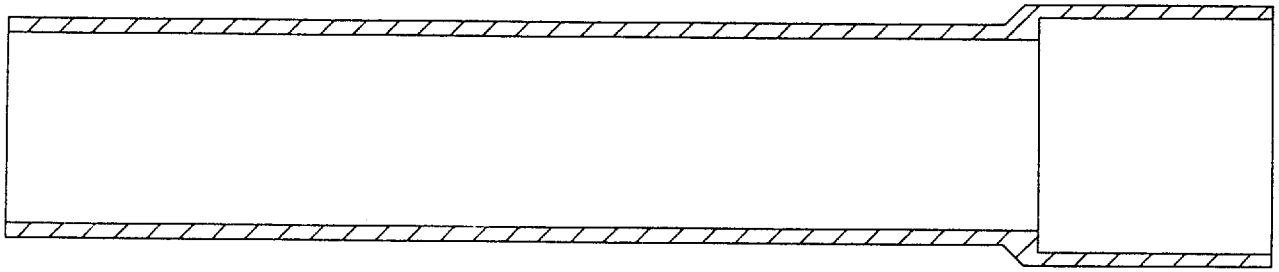
Prior Art FIG. 2
FIG. 2 is a cross-section view showing an accessory device of the prior art.
Figure 3:
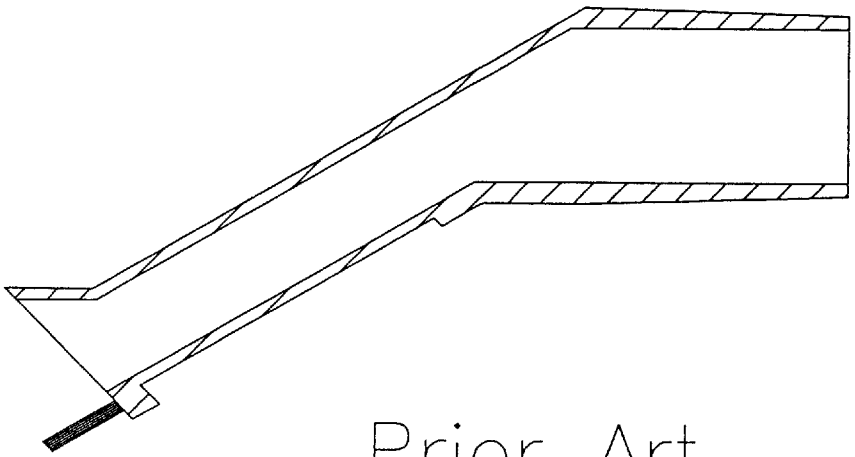
Prior Art FIG. 3
FIG. 3 is a cross-section view showing another accessory device of the prior art.
Figure 4:
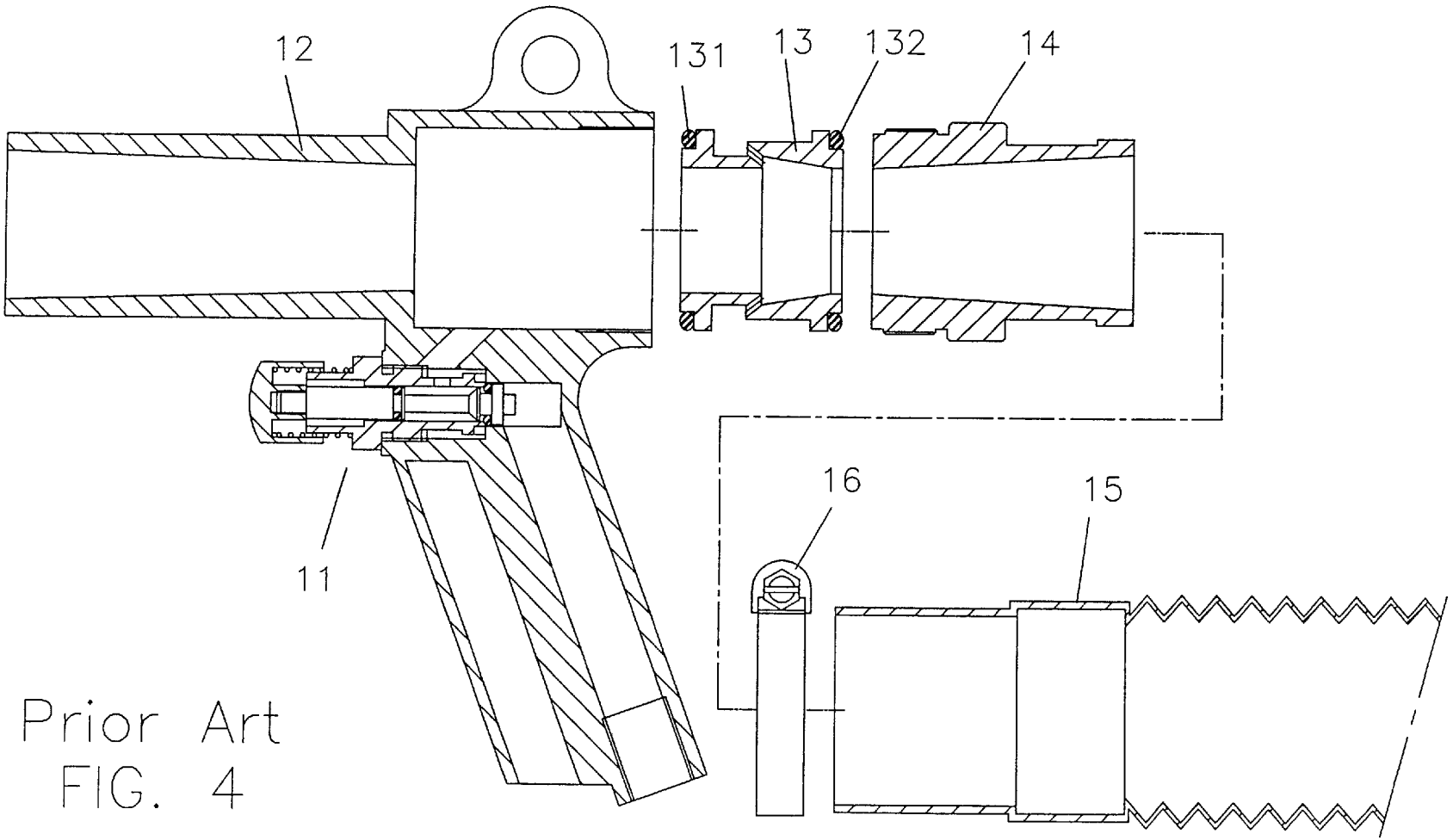
Prior Art FIG. 4
FIG. 4 is a cross-section view showing the parts of the prior art device of FIG. 1 disassembled.
Figure 5:
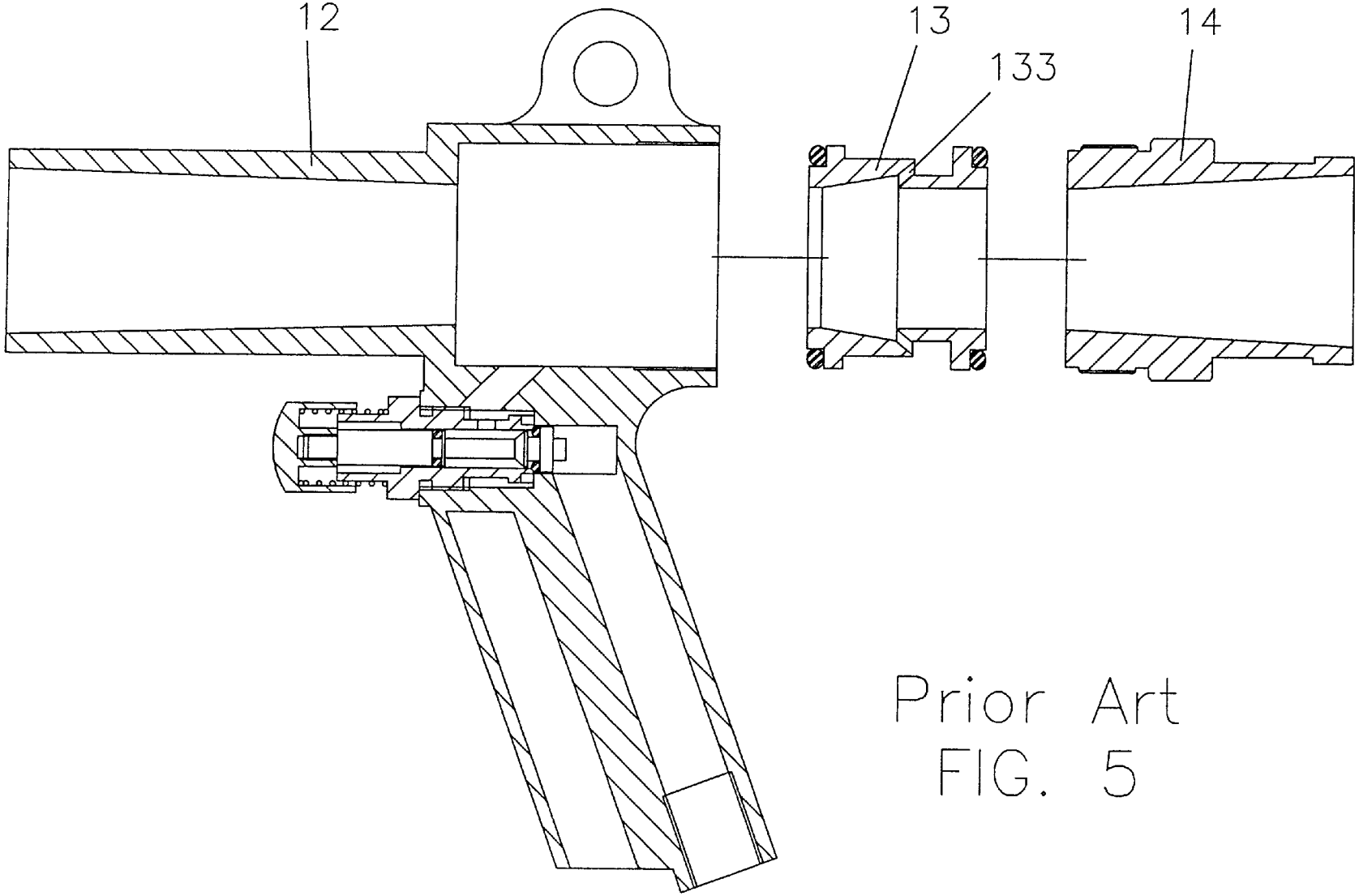
Prior Art FIG. 5
FIG. 5 is a cross-section view showing the prior art device with the direction valve re-oriented.
Figure 6:
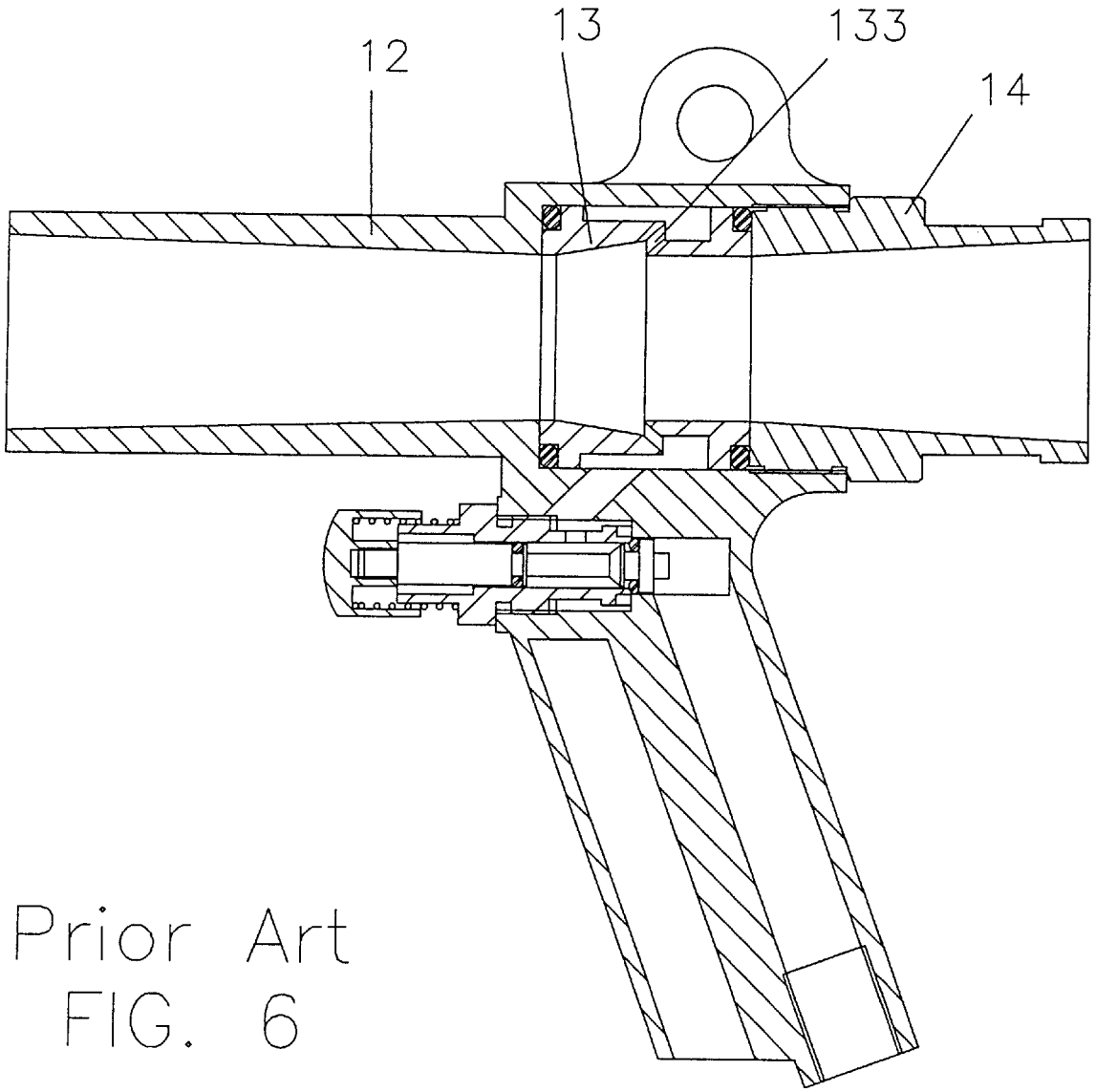
Prior Art FIG. 6
FIG. 6 is a cross-section view showing the prior art device configured as a blower.
Figure 7:
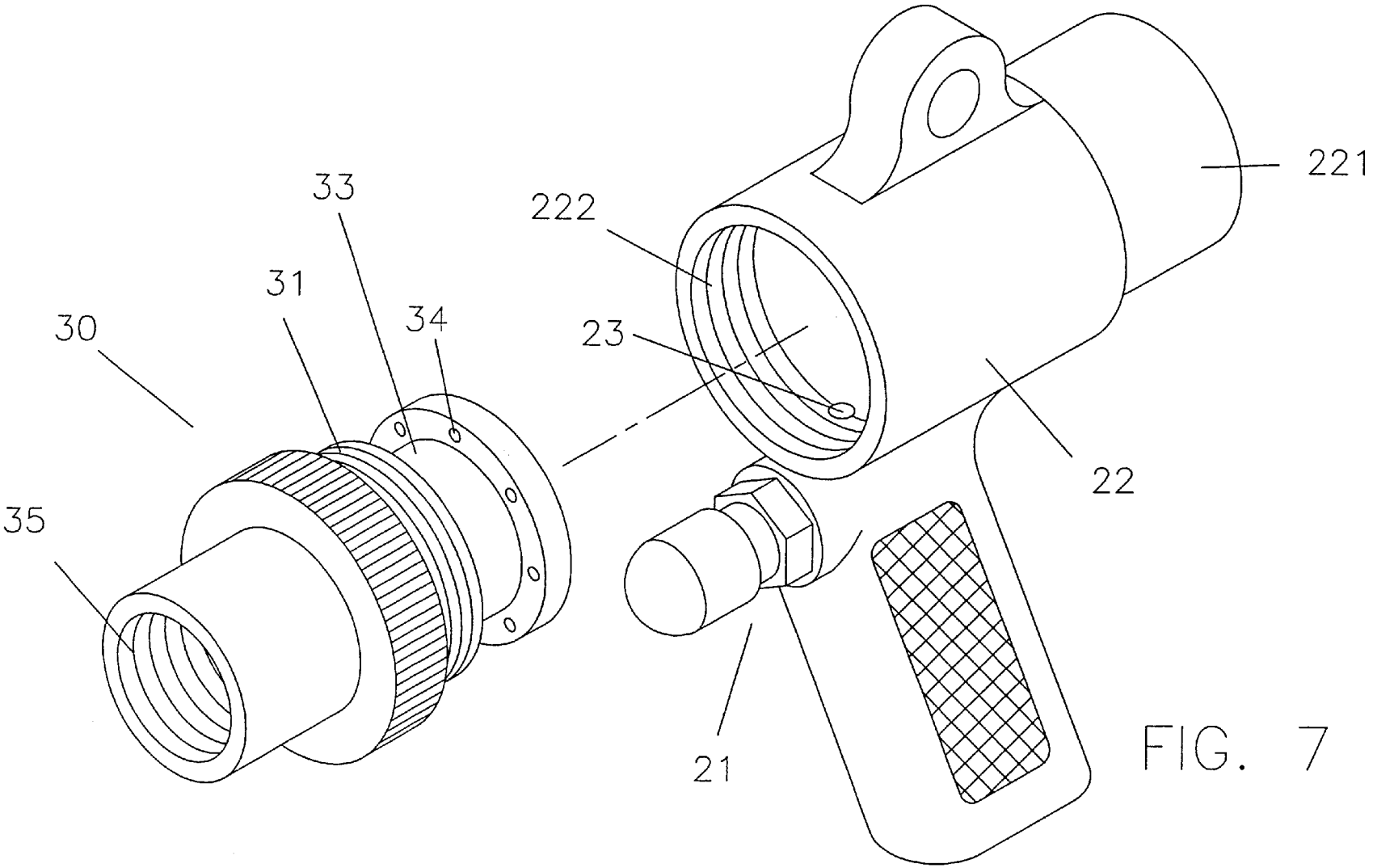
FIG. 7 is an exploded perspective view of one embodiment of the present invention.
Figure 8:
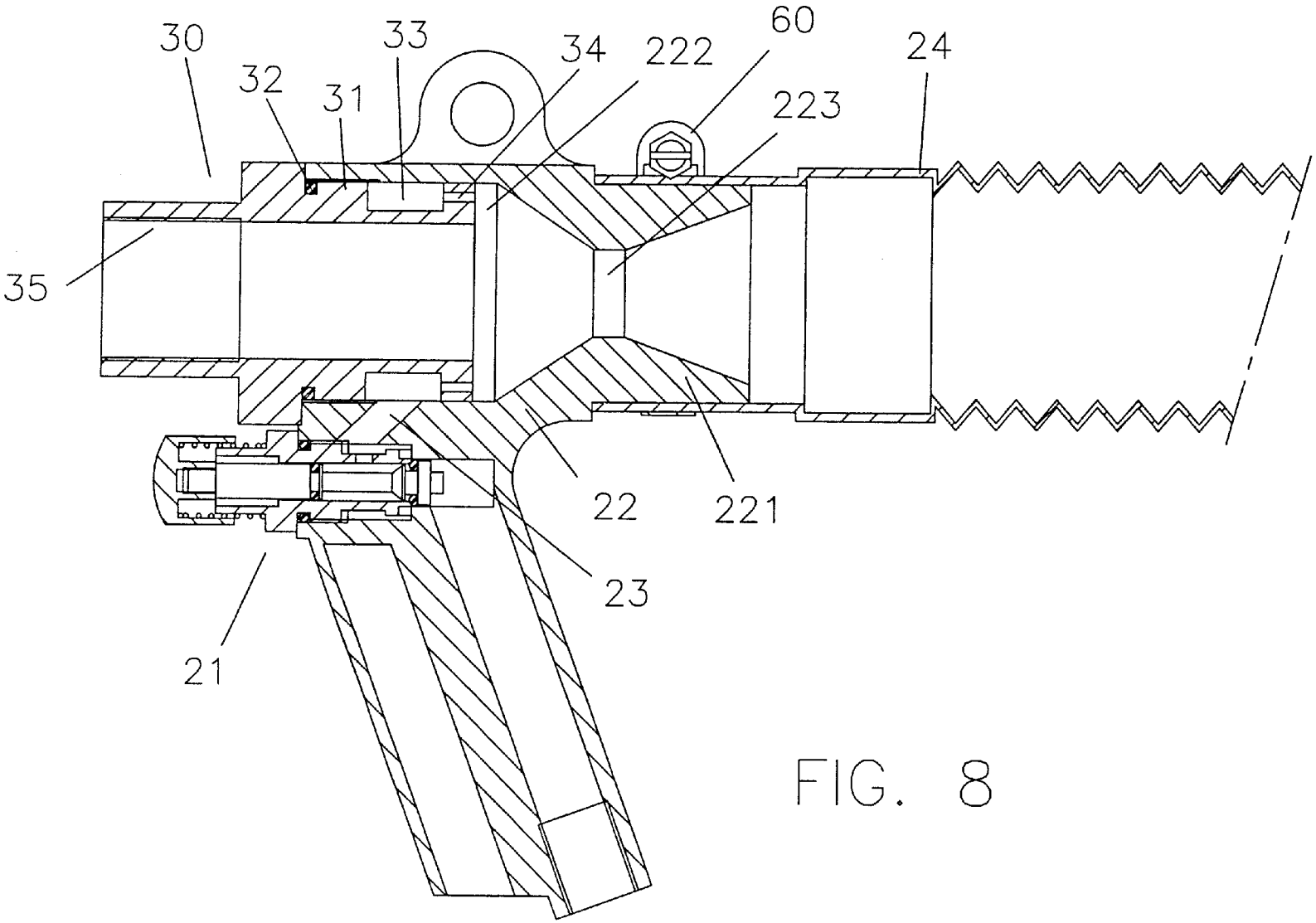
FIG. 8 is a cross-section view of one embodiment of the present invention.

Referring to FIG. 7 and FIG. 8, the present invention comprises in one embodiment an air valve 21 for controlling the introduction of compressed air, an air hole 23 connecting the air valve 21 to the inside of a body member 22, an extending portion formed at a back end of the body member 22 for the coupling of a hose 24 which is secured by a binding ring 60. A cylinder 222 is formed inside the body member 22 with a tapered throat portion 223 at its rear end. An extending cone hole is formed at the back side of the throat portion 223.

The cylinder 222 of the body member 22 has an internally threaded portion at a front end for securing an exhaust valve 30 thereto. The male threaded portion 31 is attached with an O-ring 32 at one end so as to seal the cylinder 222, while at its other end there is formed a ring groove 33 defining a circular air cabin communicating with the air hole 23. A plurality of axial guide air holes 34 which communicate with the ring groove 33 are drilled through the exhaust valve 30; and, an internally threaded portion 35 is formed at the opposing end of the exhaust valve 30 for receiving the blow valve 40.

Figure 9:
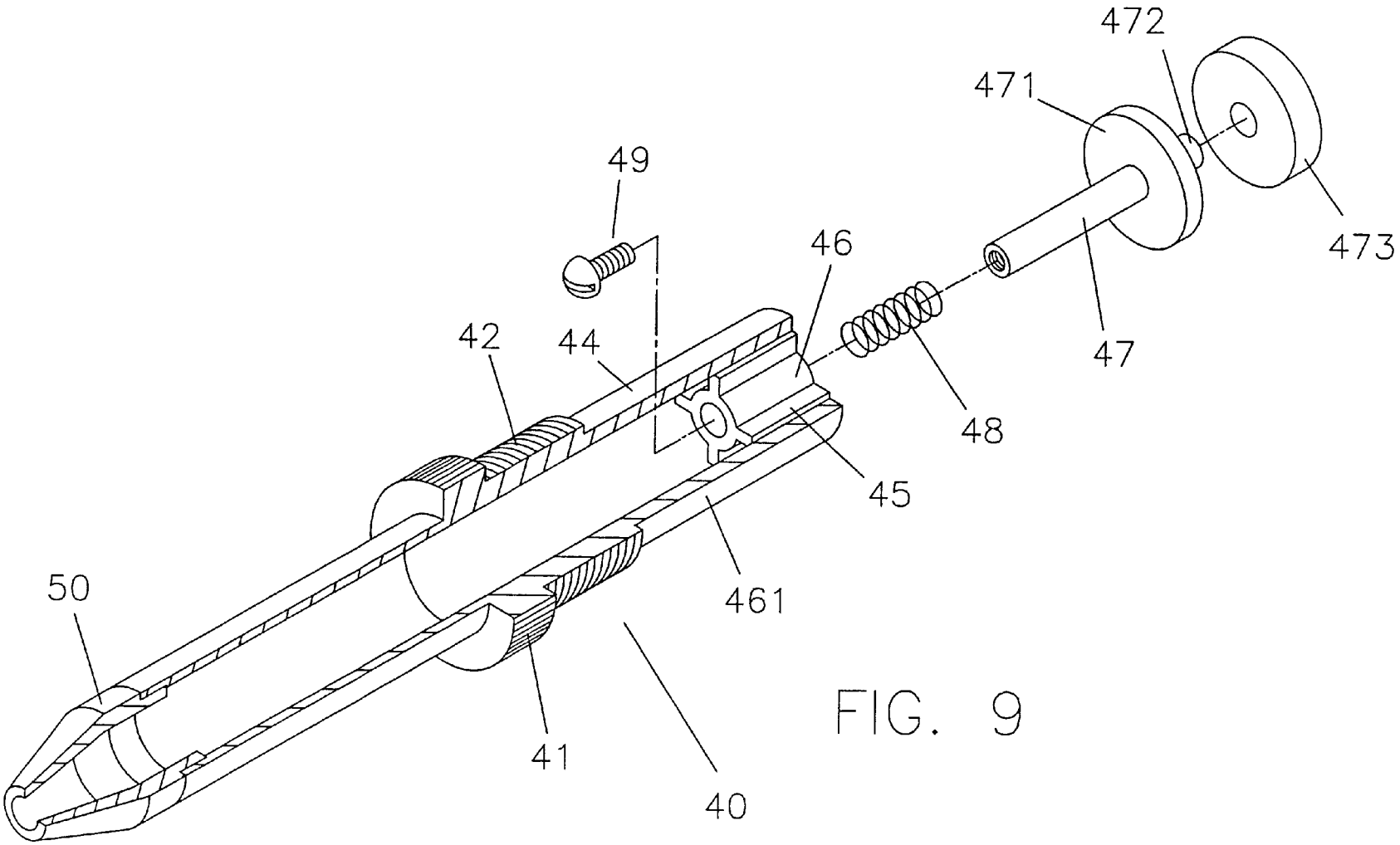
FIG. 9 is an exploded perspective view, partially cut away, showing the blow valve of the present invention.
Figure 10:
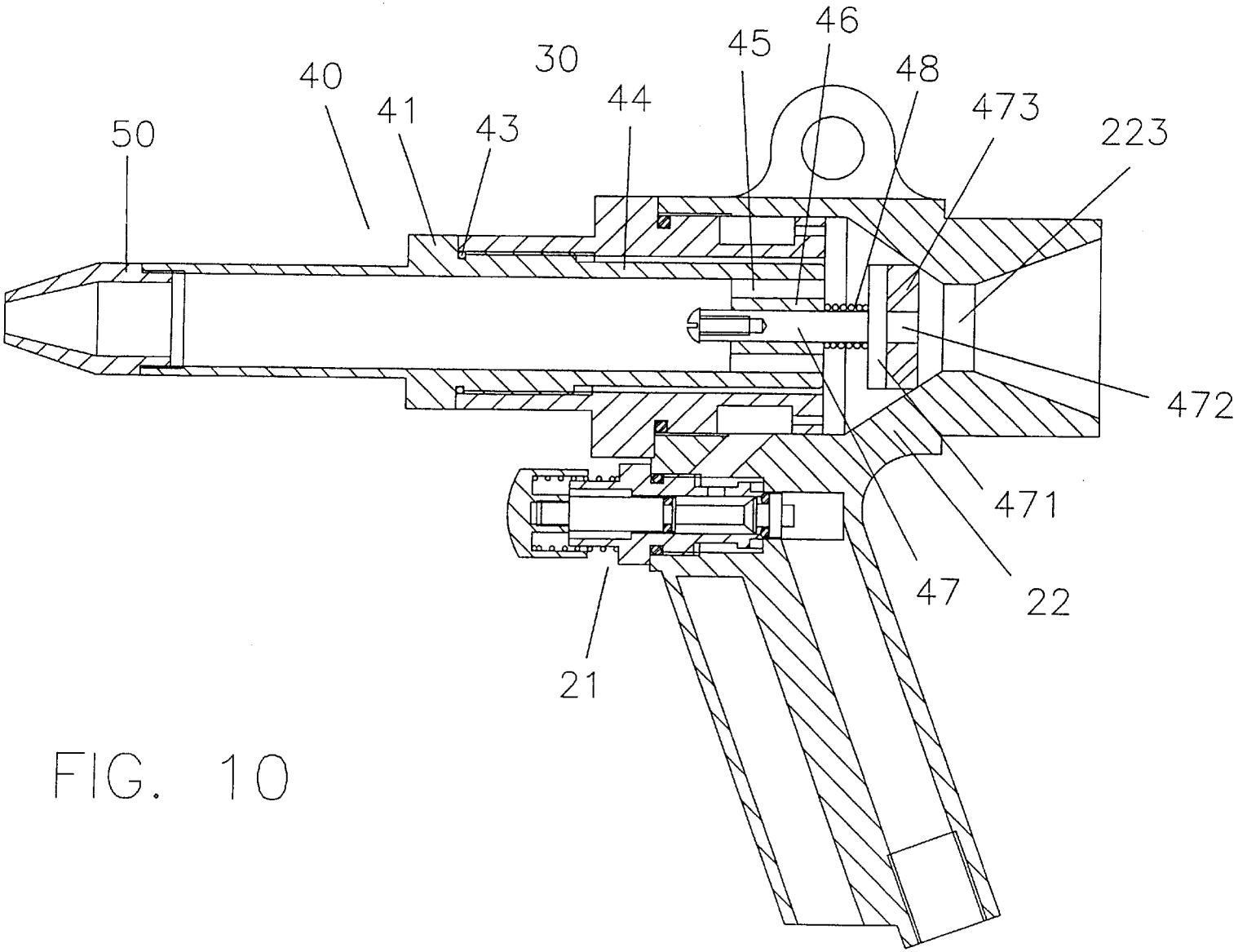
FIG. 10 is a cross-section view showing the embodiment of the present invention in its blower configuration.

Referring to FIG. 9 and FIG. 10, the blow valve 40 includes an intermediate controlling ring 41 from which extends a male threaded portion 42 to engage the female threaded portion 35 of the exhaust valve 30. An O-ring 43 is coupled to the threaded portion 42 adjacent the controlling ring 41 for sealing the exhaust valve 30 engagement. A sleeve-like extending portion 44 extends from the threaded portion 42. Within the outer end of the extending portion 44 is disposed a central shaft 46 from which a plurality of integrated fins extend radially. The central shaft sleeve 46 is formed with an inner hole 461 for coaxially receiving a slide rod 47. The slide rod 47 is formed with a flange 471 at its outer end to capture a spring 48 within the shaft sleeve 46. A securing screw 49 is coupled through the shaft sleeve 46 to engage the slide rod 47. From the flange 471 extends a lug shaft 472 for engaging a gasket seal 473. A gun-barrel extends from the opposing side of the controlling ring 41, and a cone tip 50 having a smaller diameter hole is secured to the free end of the gun-barrel to yield a blowing assembly.

Performance as an Exhaust Assembly

Figure 11:
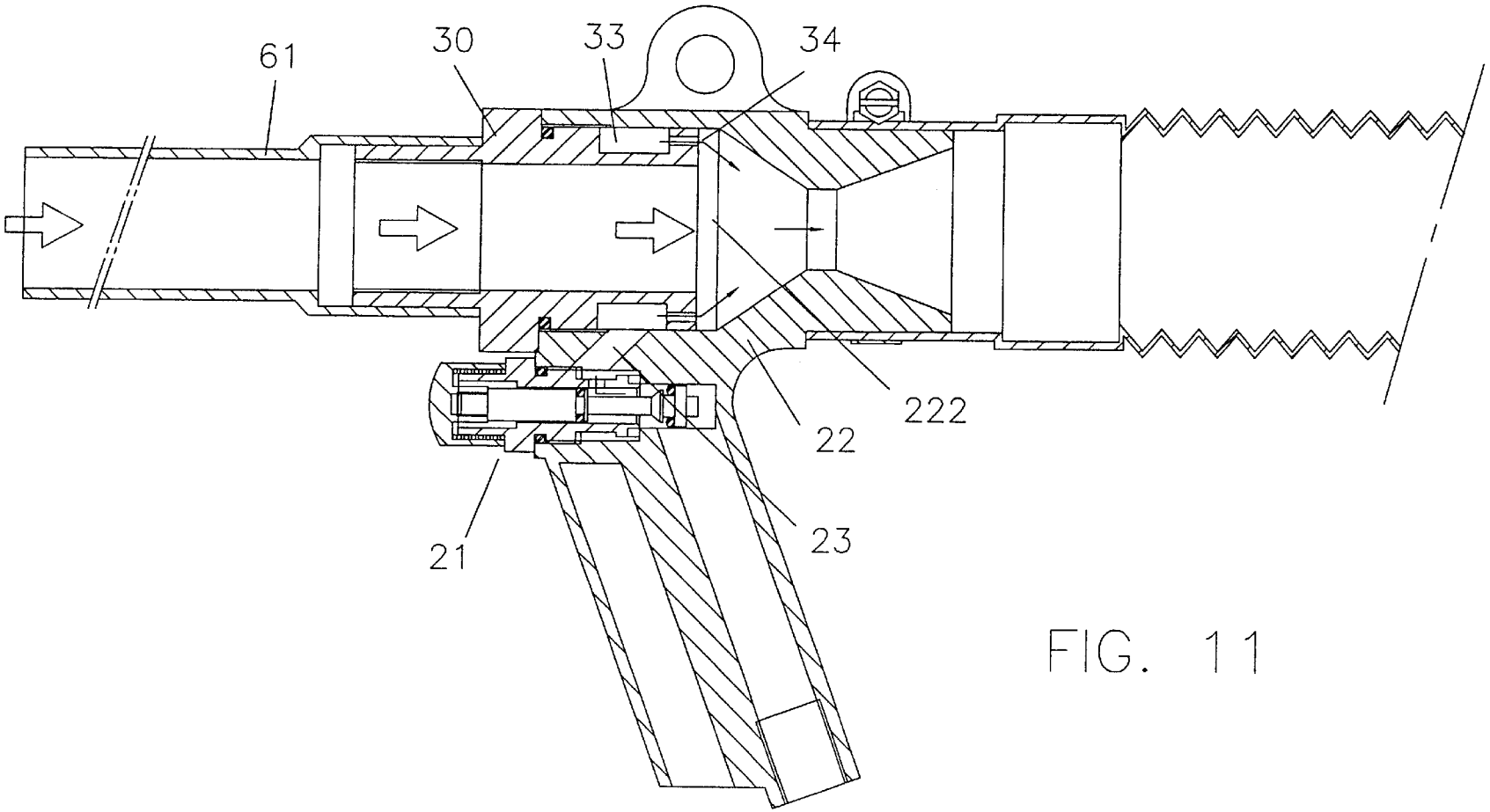
FIG. 11 is a cross-section view illustrating the embodiment of the present invention operating in its exhaust configuration; and, FIG. 12 is a cross-section view illustrating the embodiment of the present invention operating in its blower configuration.

Referring to FIG. 8 and FIG. 11, the exhaust valve 30 is secured on the body member 22 in accordance with the present invention to form an exhaust assembly. By depressing the air valve 21, the compressed air is let into the ring groove 33 of the exhaust valve 30 via the air hole 23. The compressed air then passes through the air guide holes 34 and jets into the cylinder 222 of the body member 22 to flow backward. The strong flowing air current jetting out from the air guide holes 34 generates strong suction to provide sufficient exhaust pressure for exhausting wood flour, iron scurf and other various scraps.

Performance as a Blower Assembly

Figure 12:
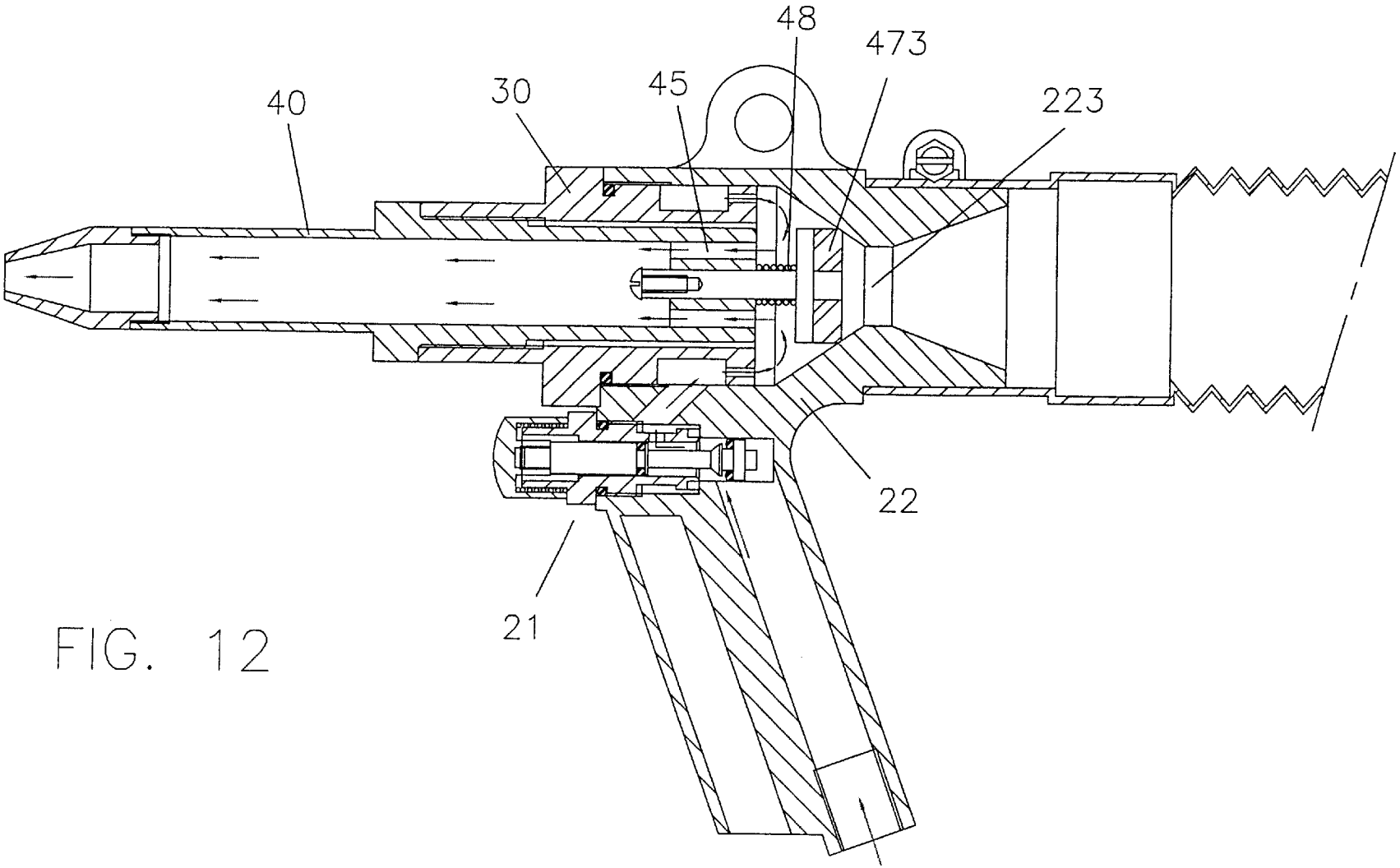

Referring to FIG. 10 and FIG. 12, the blow function is effected in accordance with the present invention by securing the blow valve 40 into the exhaust valve 30 so that the gasket seal 473 at the rear end of the blow valve 40 touches against the throat portion 223 of the body member 22 under the bias force of the spring 48 to seal backward channel. When the air valve 21 is depressed, then, the compressed air cannot jet out from the throat portion 223, and is re-directed towards the front. The re-directed air flow passes through the spaces between the fins 45 of the blow valve 40 to serve the blowing function.

What is claimed is:

1. A dual-duty apparatus selectively operable in blowing and exhausting configurations responsive to the introduction of compressed gas thereto comprising:

(a) a body member including first and second end sections and an intermediate cylinder section extending therebetween to define an axial bore, said cylinder portion having formed therein a conically contoured internal surface portion and a tapered throat portion disposed coaxially about said axial bore;

(b) an exhaust valve coupled to said first end section of said body member, said exhaust valve including inner and outer annular sections offset axially one from the other by a ring groove section defining within said body member first end section an annular air cabin, said inner annular section having formed therethrough a plurality of axial guide holes communicating with said annular air cabin, at least one of said inner and outer annular sections threadedly engaging said body member first end section in substantially sealed manner, said exhaust valve further including a coupling section extending axially outward from said outer annular section;

(c) a blow valve detachably coupled to said exhaust valve, said blow valve including:

(1) a substantially tubular member having coaxially disposed gun-barrel and tail sections, and a controlling ring section extending therebetween, said controlling ring section threadedly engaging said coupling section of said exhaust valve in substantially sealed manner;

(2) a conical tip nozzle coupled at a terminal end of said gun-barrel section;

(3) a central shaft sleeve member disposed within said tail section, said central shaft sleeve member having a plurality of angularly offset fins extending radially therefrom;

(4) a slide rod coaxially received in said central shaft sleeve member in spring biased manner, said slide rod having formed thereon a radially flared flange;

(5) a gasket seal coupled to said flange;

said gasket seal engaging said conically contoured internal surface portion of said body member in substantially sealed manner to obstruct said axial bore upon said coupling of said blow valve to said exhaust valve, whereby the compressed gas introduced into said body member is deflected to said blow valve for expulsion through said gun-barrel section thereof.

* * * * *